US005627947A

United States Patent [19]

Chan et al.

[11] Patent Number: 5,627,947

[45] Date of Patent: May 6, 1997

[54] VARIABLE-DURATION PRINTER CARRIAGE MOTOR ACCELERATION METHOD AND APPARATUS

[75] Inventors: James L. K. Chan; Ah B. Tan, both of Singapore, Singapore

[73] Assignee: Hewlett-Packard Company, Palo Alto, Calif.

[21] Appl. No.: 629,322

[22] Filed: Apr. 8, 1996

Related U.S. Application Data

[63] Continuation of Ser. No. 145,281, Oct. 29, 1993.

[51] Int. Cl.[6] ..... B41J 19/30

[52] U.S. Cl. ..... 395/105; 400/124.11

[58] Field of Search ..... 395/101, 105, 395/109, 111, 117, 550; 358/412, 413; 400/76, 322, 323, 124.11, 144.2; 364/174; 355/243; 382/122

[56] References Cited

U.S. PATENT DOCUMENTS

| | | | |
|---|---|---|---|
| 4,079,298 | 3/1978 | Prager | 318/260 |
| 4,324,499 | 4/1982 | Giacone | 400/144.2 |
| 4,332,461 | 6/1982 | Cail et al. | 355/143 |
| 4,529,281 | 7/1985 | DeRoche et al. | 353/27 A |
| 4,541,334 | 9/1985 | Liedtke et al. | 101/93.18 |
| 4,648,026 | 3/1987 | Petricu | 364/174 |
| 4,691,150 | 9/1987 | Jen | 388/812 |
| 4,772,837 | 9/1988 | MacMunn | 318/687 |
| 4,775,087 | 10/1988 | Moser et al. | 226/143 |
| 4,775,945 | 10/1988 | Cavill et al. | 395/105 |
| 4,777,609 | 10/1988 | Cavill et al. | 345/105 |
| 4,827,282 | 5/1989 | Ritchie | 347/47 |
| 4,869,610 | 9/1989 | Nishizawa et al. | 400/332 |
| 4,929,099 | 5/1990 | Graham et al. | 400/76 |
| 5,207,520 | 5/1993 | Tanaua | 400/279 |
| 5,216,754 | 6/1993 | Sathi et al. | 345/115 |
| 5,238,315 | 8/1993 | Kitabata | 400/314.1 |
| 5,527,121 | 6/1996 | Santon | 400/323 |

*Primary Examiner*—Leo Boudreau
*Assistant Examiner*—Gabriel I. Garcia

[57] ABSTRACT

Method and apparatus are described for accelerating a printer carriage motor for variable durations depending upon the available time between a lateral carriage stop and the first data to be printed in a given swath. The printer's controller is programmed to preview buffered print data, to determine for each print swath when the first printable matter will be printed and to cause the carriage motor to accelerate a variably greater length of time until such printable matter is to be printed. The controller causes the printhead to prim such printable matter in each swath at variably higher speeds representing the amount of time the motor was accelerated.

11 Claims, 2 Drawing Sheets

VARIABLE-DURATION PRINTER CARRIAGE MOTOR ACCELERATION METHOD AND APPARATUS

This is a continuation of application Ser. No. 08/145,281 filed on Oct. 29, 1993, now abandoned.

TECHNICAL FIELD

The present invention relates generally to printer carriage control. More particularly, the invention concerns method and apparatus by which higher printer throughput is obtained by automatically varying the duration of the carriage motor's acceleration based upon the non-printing margin available in a given print swath.

BACKGROUND ART

In conventional printers, the maximum speed of a carriage-mounted, reciprocating printhead has been fixed by the distance available for the printhead to accelerate from either lateral stop to the near edge of the virtual image that is printable. For example, if the printer provides 0.5 inch for the printhead to accelerate, and if the maximum acceleration provided by the carriage motor is 100 inches/second$^2$, then the top speed attainable by the printhead is 10 inches/second (ips). In order to increase printhead speed—and thus printed matter throughput-the carriage motor could provide more torque and acceleration, or the printer could provide more widely spaced stops, and thus wider margins, from which the printhead may accelerate to a higher top speed, or both. Either would be costly; both might be prohibitive.

DISCLOSURE OF THE INVENTION

The invented method and apparatus automatically vary the top speed achieved by the printhead carriage based upon the available margin, during which the carriage motor may accelerate, between either lateral carriage stop and the first printable matter encountered in any given print swath. The printer's microcontroller automatically determines the length of motor speed ramp-up time that is available by previewing the printed matter data in memory and steps the carriage motor throughout such period representing variable margins in the to-be-printed line or swath. In the exceptional case, where there is printed matter within the near printable document border, e.g. approximately 0.125 inch, the motor's speed is limited to prior art speeds, but in the vast majority of cases, where there is no printed matter within the printable border, e.g. the case in which the document has 1.0 inch borders, the motor reaches substantially higher speeds. Such higher speeds and increased printed matter throughput thus are achieved by making the printer smarter, without increasing the motor's robustness or the printer's footprint, and at the much lower cost of modifying the controller's microcode.

The apparatus of the invention can be summarized as an improvement whereby the printer's controller capable of previewing print data determines for each print swath when the first printable matter will be printed and causes the carriage motor to accelerate a variable length of time until such printable matter is to be printed and causes the printhead to print such printable matter of successive swaths at variable speeds representing the amount of time the motor was accelerated. The method of the invention may be summarized as involving previewing printable image data for each pass of the printhead carriage to determine a maximum acceleration period and accelerating the motor substantially throughout such a determined period of time, and repeating such steps for successive passes of the printhead. By both improvements, acceleration periods corresponding with successive passes of the printhead vary in accordance with the first printable image location during each pass and data is printed at higher speeds than are achievable with comparable prior art method and apparatus.

These and additional objects and advantages of the present invention will be more readily understood after a consideration of the drawings and the detailed description of the preferred embodiment.

DETAILED DESCRIPTION OF THE PREFERRED EMBODIMENT AND BEST MODE OF CARRYING OUT THE INVENTION

Figure 1:
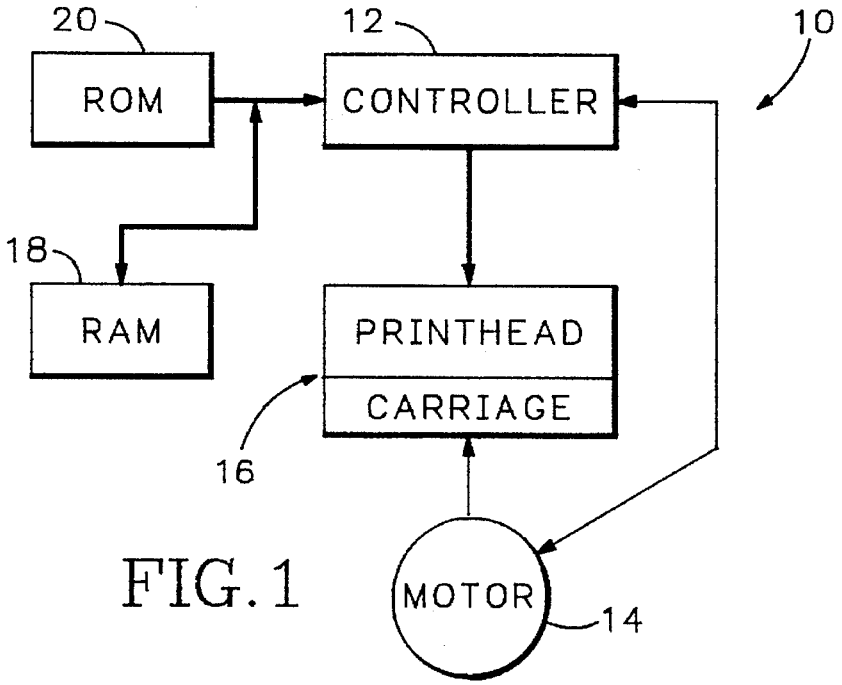
FIG. 1 is a schematic block diagram of the invented apparatus made in accordance with its preferred embodiment.

FIG. 1 shows in schematic block diagram form the invented variable-duration carriage acceleration apparatus in its preferred embodiment, indicated at 10. Apparatus 10 preferably includes a controller, e.g. a microprocessor and associated control circuitry, 12; a carriage motor 14 for reciprocating a carriage-mounted printhead 16; a print data buffer, e.g. a read-and-write memory (RAM) device, 18; and parameter store, e.g. a read-only memory (ROM) device, 20. Those skilled in the art will appreciate that controller 12 is coupled with motor 14, printhead 16, RAM 18 and ROM 20 such that it executes instructions stored in ROM 20 to reciprocate carriage motor 14 and printhead 16 to cause printable data stored in RAM 18 to be printed on print media advanced, line by line or swath by swath, within a printer such as a desktop inkjet printer. Within the spirit and scope of the invention, alternative system topologies and/or controller architectures may be used.

Typically, carriage motor 14 has a predetermined, relatively low torque and capacity to accelerate and decelerate carriage-mounted printhead 16 between nominal stops defined by the printer's physical configuration including a desirably small footprint. Controller 12 produces control signals, e.g. stepper pulses, that command carriage motor 14 controllably to advance in either direction. Controller 12 also produces printable data signals that represent pixel images to be transferred to the advancing print media by inkjets within printhead 16. Print media advancement is controlled also typically by controller 12 via a sheet feed mechanism that may be driven by the same or a different motor and a suitable drive train.

In accordance with the invented apparatus in its preferred embodiment, controller 12 previews the print data in buffer 18 to determine the maximum available acceleration period representing the distance between a nominal stop location and the location of the first printable image data for each pass of printhead 16. Based upon this determination, controller 12 produces control signals to carriage motor 14 that cause printhead 16 to advance in accordance with a predetermined acceleration profile substantially throughout such period. Controller 12 then communicates print data within buffer 18 to printhead 16 as carriage motor 14 reciprocates the printhead across the print media to print a swath of the printable image.

Importantly, the greater the available acceleration period, the higher the print speed and the greater the printer throughput. In the case of print images having substantial margins, e.g. approximately 1.0 inch, carriage speeds may be increased by as much as two to three times in accordance with the invention. No speed penalty is incurred in the case of print images having insubstantial margins, e.g. approximately 0.125 inch, because controller 12 previews printable data for successive print 'swaths, or printhead passes, within a negligible amount of time that is masked by physical latencies inherent in operation of the printer. Thus, higher carriage motor speeds are attained without exceeding the nominal predetermined acceleration capacity of carriage motor 14 and without increasing the printer's footprint.

Apparatus 10 is compatible with bi-directional printing, wherein another advantage of the invention may be understood. Toward the end of a given print swath, controller 12 already may be previewing the printable data within buffer 18 for a return print swath. Thus, it may be determined by controller 12 how much acceleration time is available during successive carriage passes even before the carriage reaches the end of the current pass. Persons skilled in the art will appreciate, however, that such determining requires only negligible time relative the time required to accelerate the carriage to a suitably high print speed.

Within the spirit and scope of the invention as it pertains to bi-directional printing, controller 12 might also while previewing printable data determine the last printable data within the current print swath. Controller 12 then may cause carriage motor 14 to begin decelerating immediately upon the printing of the last print image in the swath, thereby increasing the available deceleration period for each printhead pass. Such deceleration may be in accordance with one or more predetermined deceleration profiles stored in memory such as ROM 20. Plural deceleration profiles might be used (as might plural acceleration profiles), wherein their differences accommodate more or less rigorous braking and attendant taxing of carriage motor 14. This advantageously may extend the life of carriage motor 14 by reducing torque thereon to a selected torque and acceleration capacity versus life expectancy rating, depending upon how much deceleration time is available without sacrificing throughput.

It will be appreciated that, after such deceleration period, carriage motor 14 is reversed and the previewing, accelerating, printing and decelerating steps are repeated for subsequent, preferably bi-directional passes of the printhead. It will be understood that it may be to further advantage for controller 12 to preview a next print data swath while carriage motor 14 is decelerating from the printing of a preceding swath, such that each subsequent previewing step at least partly, and preferably fully, overlaps a corresponding earlier decelerating step.

Figure 2:
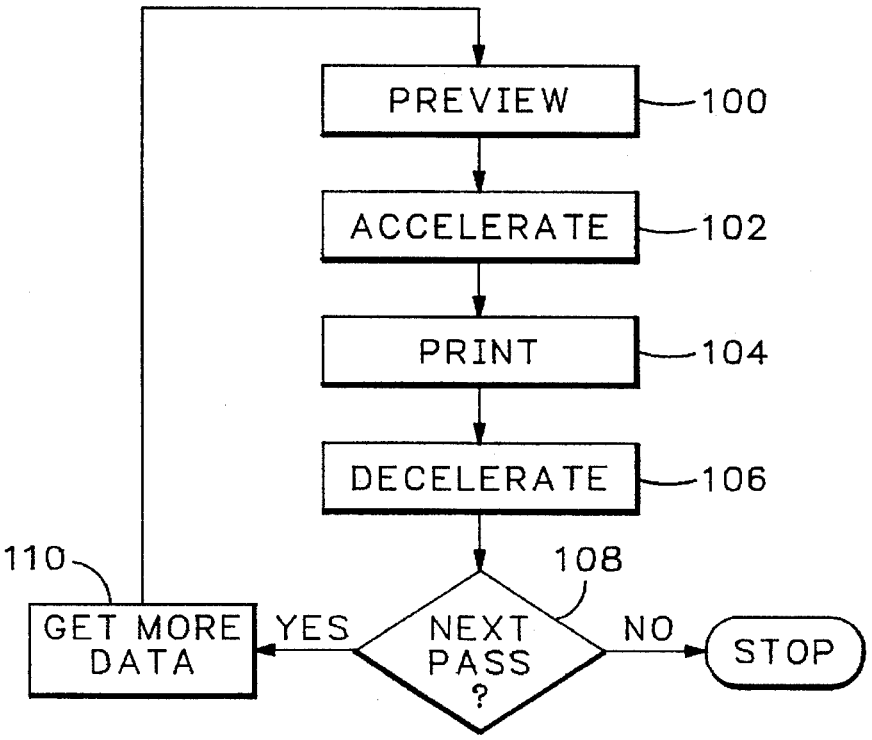
FIG. 2 is a flowchart illustrating the preferred method of the invention.

Turning now to FIG. 2, the preferred method of the invention-by which a printhead carriage motor in a printer having print data stored in its memory better may be controlled—is described. The illustrated method may be understood from the flowchart of FIG. 2 to include the steps of 1) previewing the print data to determine the location of the first printable data will be encountered during printhead movement, as indicated generally at 100; 2) accelerating the carriage motor for a determined amount of time corresponding to the printhead's having reached such location, as indicated generally at 102; and 3) printing printable data starting at such determined location at a carriage motor speed corresponding at least in part with the predetermined acceleration for the determined amount of time, as indicated generally at 104. Optionally, as indicated generally at 106, the carriage motor is decelerated, preferably as described above or more conventionally. At 108, it is determined whether another pass is required to print the image. If so, more data is obtained at 110; if not, processing STOPs.

It will be understood by skilled persons that the maximum speed of carriage motor 14 may be limited to a predetermined maximum speed, thereby to protect carriage motor 14 or to preserve the integrity of the communication of data from controller 12 to printhead 16. Such limiting may be accomplished by calculating the effective speed (i.e. angular velocity) of the carriage motor based upon the predetermined acceleration parameter that may be stored in ROM 20 and based also upon the determined amount of time of acceleration. Moreover, the accelerating step may be performed in accordance with a predetermined acceleration profile, e.g. that shown in FIG. 3B to be described below, with the profile also being stored in ROM 20. Such very straightforwardly may be accomplished by programming the microprocessor of controller 12.

While it is preferable to buffer at least one print swath of print data in RAM 18, such will be understood not to be necessary. What is needed very simply is the ability of controller 12 to determine the optimal amount of time during which the carriage motor can be accelerated to good speed advantage, and such would be possible by buffering only a volume of print data that effectively gives a measure of the distance the carriage may travel while accelerating before leveling off to a constant printing speed. It will be appreciated that, when printable data is encountered later in time, e.g. deeper in such buffer 18, it represents a longer acceleration time and will result in a higher speed printout of the swath containing the data than when the printable data is encountered earlier in time, e.g. shallower in buffer 18.

The invented method will be understood to permit carriage motor 14 to attain variable top speeds, without any required increase in acceleration, corresponding to the variable length of time that controller 12 commands its advance. The result is artificially intelligent, variable speed control of the carriage motor enabling higher printer throughput on print tasks wherein the actual print image is narrower than the virtual print image defined by the printer's physical configuration. In written correspondence and other text applications that are characterized by approximately 1.0 inch left and right margins containing no printed matter, print speeds and single sheet media throughput typically may be increased by a factor of at least approximately two or three (based upon the square-law correspondence between acceleration and speed).

The invented method may be seen to represent a significant improvement over prior art methods for controlling a printhead carriage motor, in a printer having data stored in its memory. Such prior art controlling methods are characterized as including the steps of accelerating the carriage motor for a period of time between a nominal stop location and a first printable image location. The improvement may be understood to include previewing printable image data for each pass of the printhead carriage effectively to determine a maximum acceleration period, as indicated at 100 (FIG. 2); and accelerating the carriage motor substantially throughout such determined acceleration period, as indicated at 102 (FIG. 2). Preferably, such previewing and accelerating steps are repeated for successive passes of the printhead, and corresponding acceleration periods of the successive passes vary in accordance with the first printable image location during each printhead pass, as indicated by the directed flow control paths between next pass decision block 108 and previewing step 100 (FIG. 2).

The important previewing step described above will be understood by those of skill in the art effectively to determine a maximum acceleration period, whether or not there is explicitly such a determination made. In other words, it is within the spirit and scope of the invention for controller 12 simply to count a number of timing intervals, to count a number of character spaces, to count a number of pixel locations, to subtract a first from a second address or pixel location indicium effectively to obtain a spacing distance measurement, etc. Thus, pixel counts, distance measurements or time measurements or derivations thereof or therefrom all are contemplated by the invention, with or without any express time or time lapse determination, as such readily can be used variably to control the acceleration period of carriage motor 14.

The invented apparatus now may be understood also to represent a significant improvement over prior art apparatus. The improvement may be described in the context of a reciprocable carriage printhead printer, wherein the carriage is reciprocated by a motor having a given acceleration capacity. The improvement may be described as including a smart controller 12 operatively connected with, thereby to control the speed of, the motor. As described above by reference to FIGS. 1 and 2, smart controller 12 is capable of previewing print data for each print swath or line thereby to determine when the first printable matter will be printed. Also as described above, smart controller 12 causes the motor to accelerate for a variable length of time substantially until such first printable matter is to be printed. Thus, smart controller 12 causes the printhead to print successive swaths of such printable matter at variable speeds representing such variable lengths of time the motor was accelerated.

Figure 3A:
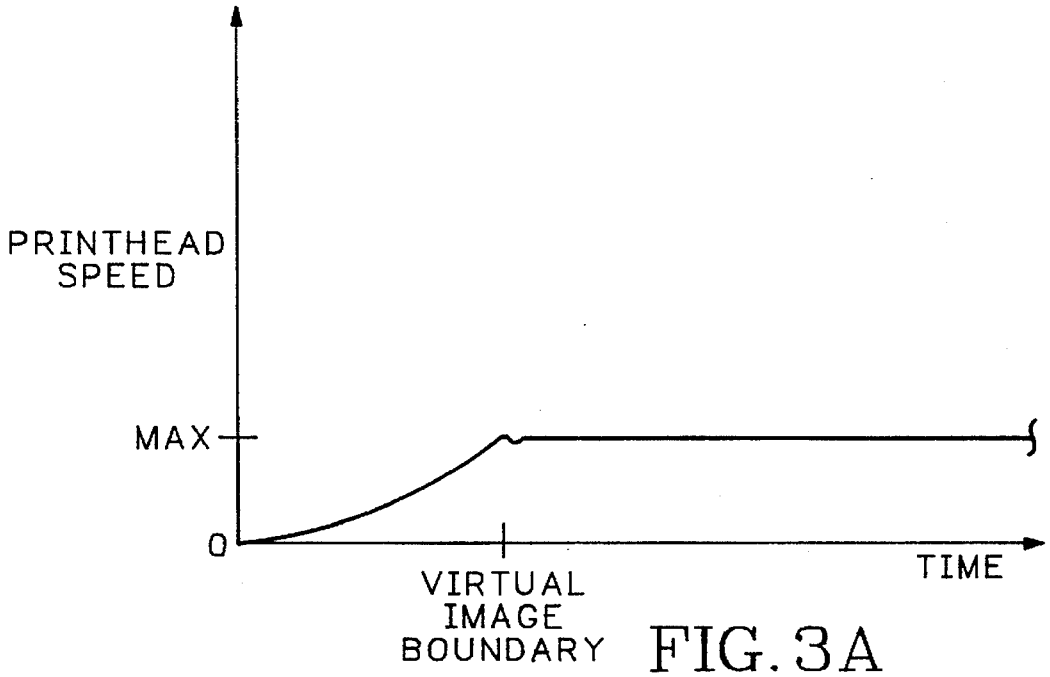
FIG. 3A (PRIOR ART)
FIGS. 3A and 3B are graphs showing the higher printhead speeds achieved by the invention over prior art method and apparatus.
Figure 3B:
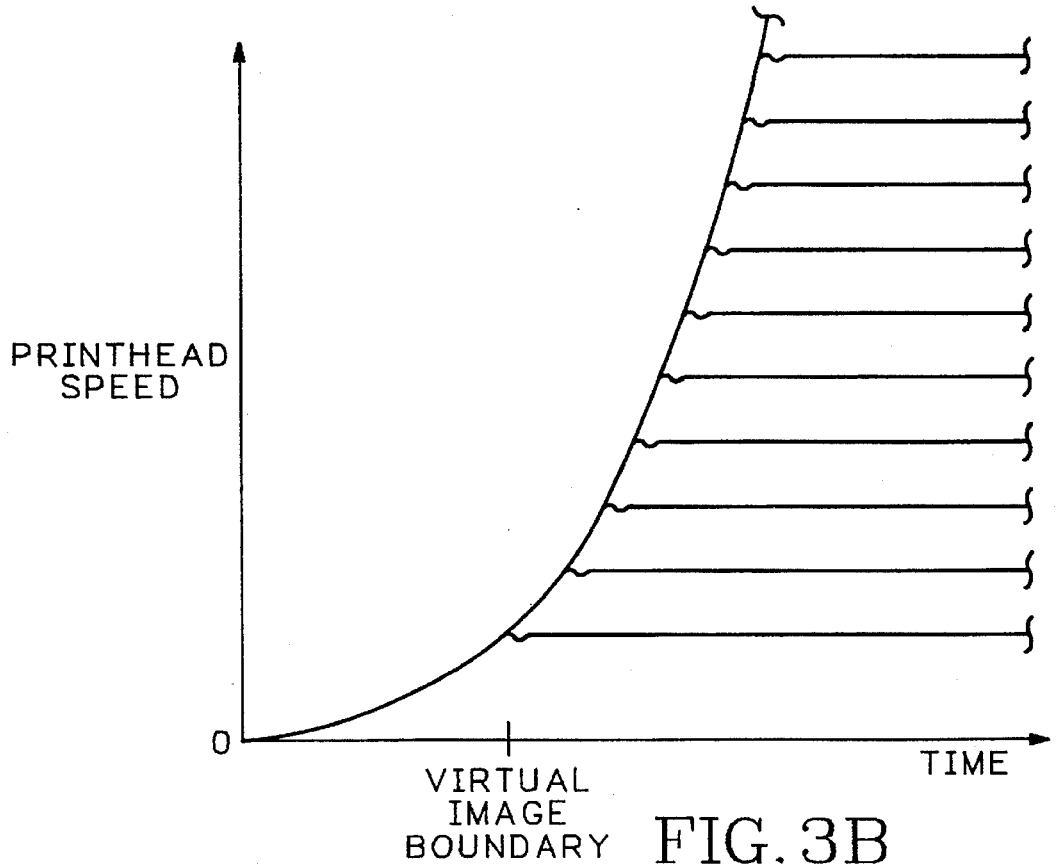

FIGS. 3A and 3B illustrate these improvements, and the advantages of the invented method and apparatus over those of the prior art. FIG. 3A is a graph of prior art methods that use a fixed-duration acceleration ramp for printhead carriage motor control. It shows printhead speed over time during such acceleration and shortly thereafter, wherein the top speed of the printhead is fixed by the acceleration profile and the fixed time duration. FIG. 3B is a graph of the invented method that uses a variable-duration acceleration ramp, whereby the printhead's top speed is variable and is determined by the same acceleration profile but a variably longer time duration.

It may be seen from FIG. 3B that, depending upon the time available for printhead acceleration between a nominal stop position and a first printable image location, e.g. an actual image boundary encountered later than is the virtual image boundary, the top speed achieved by the printhead may be greatly increased. By the invented method and apparatus, the printhead carriage while printing operates within the horizontally lined area of the graph that represents a variety of top speeds all of which are greater than or equal to that achieved by prior art method and apparatus of comparable cost and reliability.

Industrial Applicability

It may be seen than that the invented method and apparatus greatly increase carriage printer throughput, with negligible incremental cost, by intelligently increasing the top speed of the printer's carriage depending upon the amount of time available for beginning-of-print-swath acceleration. The printer's controller need only preview successive print swath images and utilize the maximum amount of time available for acceleration between a nominal carriage stop and the location of the first to-be-printed data. The invented method and apparatus are compatible with present inkjet printer technologies, including carriage motor torque and acceleration constraints and printer housing configuration, e.g. footprint, constraints. Such variable speed control may be readily imported into existing printer installations by adding artificial intelligence in the form of firmware to an existing printer controller's microcode.

While the present invention has been shown and described with reference to the foregoing operational principles and preferred embodiment, it will be apparent to those skilled in the art that other changes in form and detail may be made therein without departing from the spirit and scope of the invention as defined in the appended claims.

We claim:

1. An improved method of controlling a printhead carriage motor in a printer having print data stored in its memory wherein the method includes the steps of accelerating the carriage motor for a period of time between a nominal stop location and a first printable image location for each of successive passes of a printhead carriage, the improvement comprising:

previewing printable image data for each successive pass of the printhead carriage to identify the first printable image location of such pass for use in determining a maximum acceleration period for each such pass, and accelerating the carriage motor substantially throughout a corresponding determined maximum acceleration period determined independently for each successive pass of the printhead carriage, the carriage motor thus being accelerated for each successive pass throughout a corresponding determined maximum acceleration period which begins at the nominal stop location and ends upon the carriage reaching the first printable image location.

2. In a printer having a printhead carriage reciprocable by a motor having a given acceleration capacity, the improvement comprising:

a controller operatively connected with the motor to control the speed of the motor, said controller independently previewing print data for each successive print swath to identify where a first printable matter will be printed for use in determining a maximum acceleration period for each such print swath, said controller causing the motor to accelerate for each successive print swath for a length of time corresponding to the maximum acceleration period of such print swath, the maximum acceleration period being determined independently for each successive print swath based on where the first printable matter of a corresponding print swath will be printed, printable matter being printed at a speed representing such length of time the motor is accelerated for such print swath.

3. An automatic method of controlling a printhead carriage motor in a printer having print data stored in its memory comprising:

independently previewing the print data of each successive pass of a printhead carriage to identify a location of the first printable data which will be printed during printhead movement of each such pass for use in selecting an optimal one of predetermined acceleration profiles stored in memory;

accelerating the carriage motor during each successive pass in accordance with the selected predetermined acceleration profile, the carriage motor being accelerated for a determined amount of time corresponding to an amount of time before which the printhead carriage reaches the first printable data location for each such pass; and printing printable data for each pass starting at the first printable data location of such pass at a carriage motor speed corresponding to acceleration in accordance with the predetermined acceleration profile for the determined mount of time of such pass.

4. The method of claim 3, wherein said accelerating step includes limiting the speed of the carriage motor to a predetermined maximum speed.

5. The method of claim 3, wherein said accelerating step includes calculating the speed of the carriage motor based upon said predetermined acceleration and said determined amount of time.

6. The method of claim 3, wherein printable data that is encountered later in time is printed at a higher speed than is printable data that is encountered earlier in time.

7. The method of claim 3 which further comprises buffering print data representing at least one print swath in the printer's memory.

8. The method of claim 3, wherein said previewing, accelerating and printing steps are performed bi-directionally with each pass of the printhead.

9. The method of claim 8 which further comprises after said printing step decelerating the carriage motor at the end of each pass of the printhead and then repeating said previewing, accelerating, printing and decelerating steps for subsequent passes of the printhead, wherein each subsequent previewing step at least partly overlaps a corresponding earlier decelerating step.

10. The method of claim 9, wherein each previewing step includes determining further the location of the last printable data and wherein the corresponding decelerating step starts substantially thereat.

11. The method of claim 10, wherein said decelerating step involves decelerating the carriage motor in accordance with a deceleration profile determined at least in part by the location of the last printable data relative to a nominal carriage stop location.

* * * * *